US007121109B2

(12) United States Patent
Heims

(10) Patent No.: US 7,121,109 B2
(45) Date of Patent: Oct. 17, 2006

(54) WATER LINE RETAINING ELEMENT FOR A REFRIGERATOR DISPENSER

(75) Inventor: Douglas A. Heims, Cedar Rapids, IA (US)

(73) Assignee: Maytag Corporation, Newton, IA (US)

( * ) Notice: Subject to any disclaimer, the term of this patent is extended or adjusted under 35 U.S.C. 154(b) by 123 days.

(21) Appl. No.: 11/033,497

(22) Filed: Jan. 12, 2005

(65) Prior Publication Data

US 2006/0150660 A1 Jul. 13, 2006

(51) Int. Cl.
*B67D 5/62* (2006.01)

(52) U.S. Cl. ..... 62/389; 222/146.6

(58) Field of Classification Search ..... 62/389, 62/391; 222/146.6, 527, 529
See application file for complete search history.

(56) References Cited

U.S. PATENT DOCUMENTS 3,429,140 A 2/1969 White
4,102,660 A 7/1978 Beckett et al.
4,543,800 A * 10/1985 Mawby et al. ..... 62/339
4,610,375 A * 9/1986 Germi et al. ..... 222/131
4,807,086 A 2/1989 Chambliss
4,912,942 A * 4/1990 Katterhenry et al. ..... 62/338
5,297,400 A 3/1994 Benton et al.
5,787,724 A * 8/1998 Pohl et al. ..... 62/389

* cited by examiner

*Primary Examiner*—William E. Tapolcai
(74) *Attorney, Agent, or Firm*—Diederiks & Whitelaw, PLC

(57) ABSTRACT

A dispenser assembly for a refrigerator includes a fill chamber and a dispenser housing positioned above the fill chamber. The dispenser is fed by a liquid supply line having a first end portion attached to a liquid source, a second end portion and an intermediate portion. The second end portion of the liquid supply line terminates at the dispenser housing above the fill chamber and is provided with a nozzle held in place by a clamp. The clamp is fixedly secured to the liquid supply line and includes a protrusion that engages a wall member on the dispenser housing to properly position the second end of the liquid supply line above the fill chamber.

19 Claims, 3 Drawing Sheets

WATER LINE RETAINING ELEMENT FOR A REFRIGERATOR DISPENSER

BACKGROUND OF THE INVENTION

1. Field of the Invention

The present invention pertains to the art of refrigerators and, more particularly, to a retaining element that positions a discharge portion of a water line above a fill chamber of a refrigerator dispenser.

2. Discussion of the Prior Art

Liquid dispensing assemblies for use in refrigerators are widely known in the art and generally include fill chambers that are recessed in a door of the refrigerator. Such liquid dispensing assemblies include a liquid supply line that either terminates in, or is attached to, a liquid discharge spout. Liquid is permitted to flow through the supply line and out from the discharge spout in response to actuation of a switch by a container placed in the fill chamber. It is further known to dispose these spouts substantially vertically and centrally at the top of the fill chamber.

The liquid supply line is typically secured to the dispensing assembly, above the filter chamber, by a friction fit arrangement or through the use of a bracket. In the case of the friction fit arrangement, a nozzle or other similar structure is formed in the dispensing assembly. The nozzle is slightly larger in diameter than the diameter of the liquid supply line. With this arrangement, an end portion of the liquid supply line is forced into the nozzle and held in place through a friction force developed as a result of the relative size differential between the nozzle and the liquid supply line. While effective, vibrations can cause the liquid supply line to slip from the nozzle and discharge liquid in a random manner. A similar arrangement would provide for the liquid supply line to be placed about an inlet tube to a nozzle. In any case, a friction fit results.

Clamping brackets are another method employed in the prior art for retaining liquid supply lines in a dispenser assembly. The clamping bracket is typically placed over a portion of the liquid supply line and thereafter fastened to a housing or other structure with a mechanical fastener. Depending upon the particular clamp used, one or two mechanical fasteners may be required to retain the liquid supply line. While this method is also effective, positioning and securing the bracket can be time consuming and result in an increase in production costs.

Therefore, despite the existence of supply line retainers employed in the prior art, there still exists a need for an inexpensive, yet effective retainer arrangement for securing a liquid supply line in a refrigerator dispenser assembly. More specifically, there exists a need for a retainer that can be readily fitted to a supply line and secured to the dispenser assembly without requiring the use of mechanical fasteners or employing a friction fit between the supply line and a nozzle to retain the line in a desired position.

SUMMARY OF THE INVENTION

The present invention is directed to a retaining element for a liquid supply line employed in a refrigerator dispenser assembly. The dispenser assembly includes a fill chamber and a dispenser housing which extends at least partially above the fill chamber. The dispenser assembly is fed by a liquid supply line having a first end portion attached to a liquid source, a second end portion and an intermediate portion. The second end portion of the liquid supply line terminates at the dispenser housing above the fill chamber.

In addition, the dispenser assembly includes a release mechanism that causes liquid to be released from the supply line in response to the insertion of a container into the fill chamber.

In accordance with the invention, the second end of the liquid supply line includes a nozzle held in place by a clamp. The clamp is fixedly secured to the liquid supply line and includes a protrusion that engages the dispenser housing to position and secure the second end of the liquid supply line above the fill chamber. Most preferably, the dispenser housing is constituted by an ice chute that leads ice from an ice maker into the fill chamber. The ice chute includes an inlet portion, an outlet portion and a main body portion. The ice chute further includes first and second wall members that project outward from the main body portion. Each of the first and second wall members include an upper surface and a lower surface. Preferably, the wall members are spaced one from the other to define a slot. The second end of the liquid supply line passes through the slot so that the protrusion on the clamp engages with the lower surface of one of the first and second wall members to retain the nozzle above the fill chamber. That is, the protrusion on the clamp prevents the second end of the liquid supply line from backing out and becoming misaligned or disengaging from the dispenser housing.

In further accordance with the invention, the ice chute includes a plurality of guide members and a retaining clip that extend outward from the main body portion. The liquid supply line passes between the plurality of guide members and is further retained by the clip to establish a smooth, curvilinear routing path. With this overall arrangement, once the second end of the liquid supply line is positioned in the slot, the intermediate portion is routed between the guide members and snap-fit into the clip. In this manner, the liquid supply line is easily secured to the dispenser housing without a concern that vibrations may cause the nozzle to dislodge.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
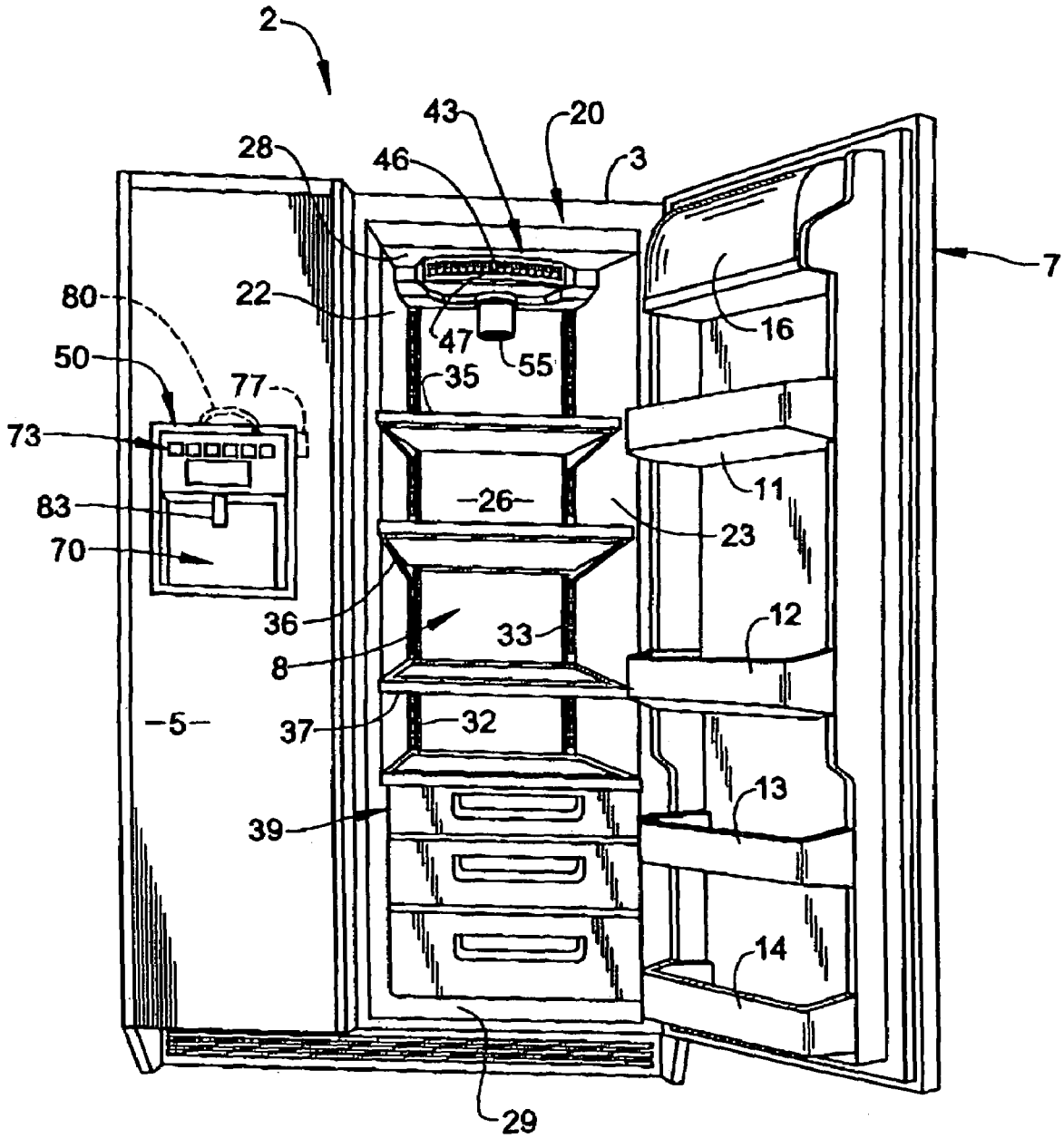
FIG. 1 is a perspective view of a side-by-side refrigerator incorporating a liquid supply line retaining element constructed in accordance with the present invention.

With initial reference to FIG. 1, a side-by-side refrigerator is generally indicated at 2. In a manner widely known in the art, side-by-side refrigerator 2 is formed from a cabinet shell 3 to which is pivotably attached a freezer compartment side door 5 and a fresh food compartment side door 7. Door 7 is shown open to expose a fresh food compartment 8 defined within cabinet shell 3. Fresh food compartment side door 7 supports a plurality of vertically spaced shelves 11–14 and is also preferably provided with a dairy compartment 16. In a preferred embodiment, fresh food compartment 8 is formed from an integral liner 20 having opposed side walls 22 and 23, a rear wall 26 and top and bottom walls 28 and 29. Secured to rear wall 26 by means of mechanical fasteners (not shown) are a pair of laterally spaced and vertically extending rails 32 and 33 that adjustably support various vertically spaced shelves 35–37. Arranged below shelves 35–37 is a shelf supporting bin assembly generally indicated at 39.

Also shown mounted within fresh food compartment 8 at top wall 28 is a temperature control unit 43. Temperature control unit 43 is preferably molded of plastic and includes upper and lower slidable temperature control members 46 and 47 which can be used by a consumer to adjust the temperatures within side-by-side refrigerator 2 to preferable levels. As will be detailed more fully below, freezer compartment side door 5 is preferably provided with a dispenser assembly 50 which can be used to selectively dispense water and/or ice.

In a manner known in the art, refrigerator 2 includes a replaceable filter, generally indicated at 55 in FIG. 1, which forms part of a water delivery system. As shown, filter cartridge 55 preferably projects downward from within a housing portion (not separately labeled) of temperature control unit 43 at a central rear portion of fresh food compartment 8. This location is utilized to provide a readily visible and easily accessible filter cartridge 55 that can be replaced by a consumer as needed. However, it should be understood other locations for replaceable filter 55 could also be employed. In general, the above-described structure of side-by-side refrigerator 2 is known in the art and does not form part of the present invention. Therefore, this description is provided for the sake of completeness. Instead, the present invention is particularly directed to a portion of the water delivery system that supply water to dispenser assembly 50.

As shown, dispenser assembly 50 includes a fill chamber 70 above which is arranged a control housing 73 that includes a plurality of control elements (not separately labeled) for selecting various functions for dispenser assembly 50. That is, the control elements enable a consumer to choose between dispensing water, cubed or crushed ice and/or control a fill chamber light (not shown). In addition, dispenser assembly 50 includes a dispenser housing 77 provided behind control housing 73 and extending above fill chamber 70. In a manner which will be detailed more fully below, dispenser housing 77 is injection molded from plastic and serves as a mounting platform for a liquid supply line 80, as well as other components associated with the operation of dispenser assembly 50. Finally, in a manner known in the art, dispenser assembly 50 is provided with a release mechanism or switch 83 that signals a controller (not shown) to allow liquid or ice to flow into a container placed within fill chamber 70.

Figure 2:
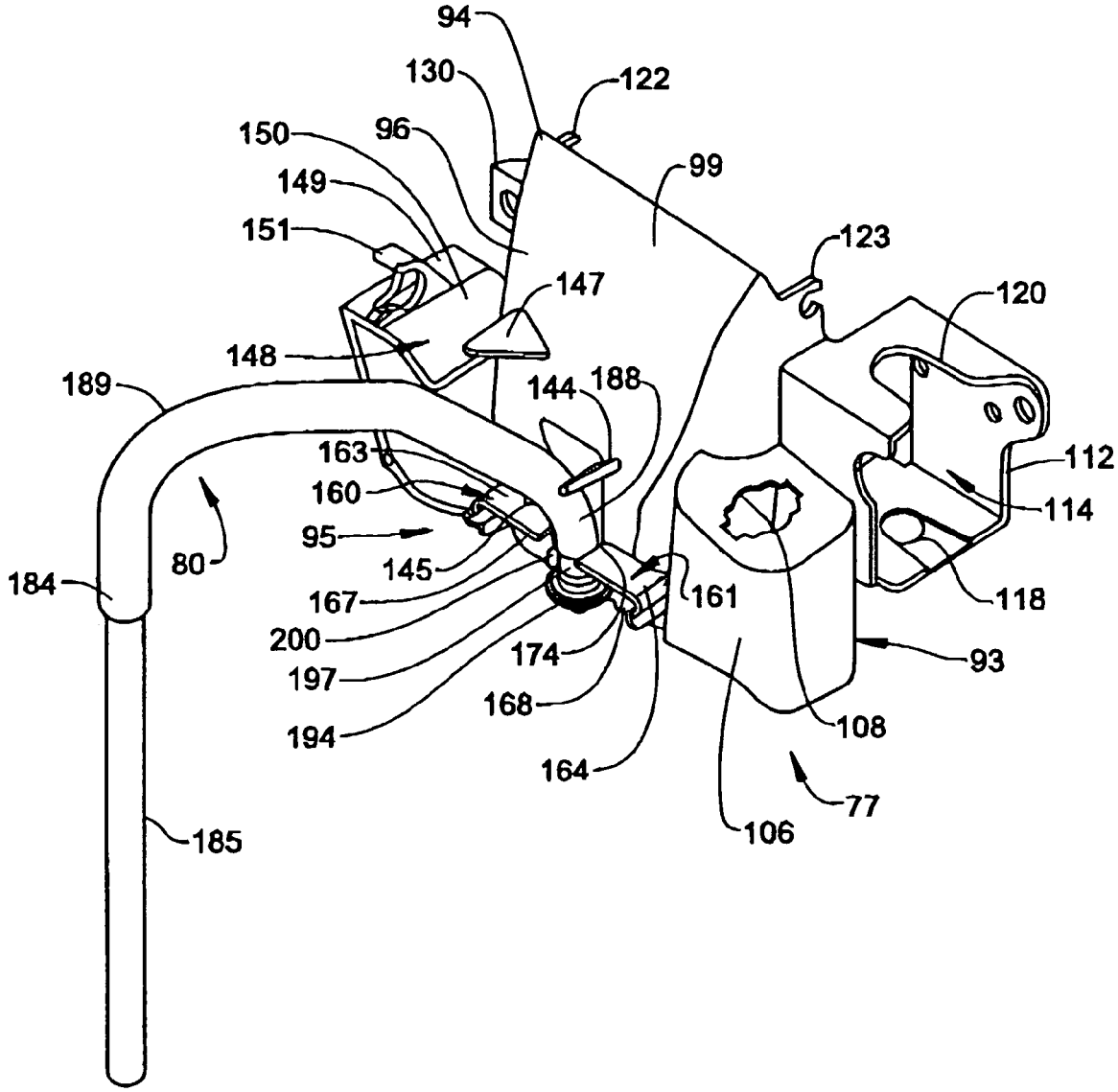
FIG. 2 is a detail view of a liquid supply line portion of the refrigerator illustrating the retaining element engaging with a dispenser housing.
Figure 3:
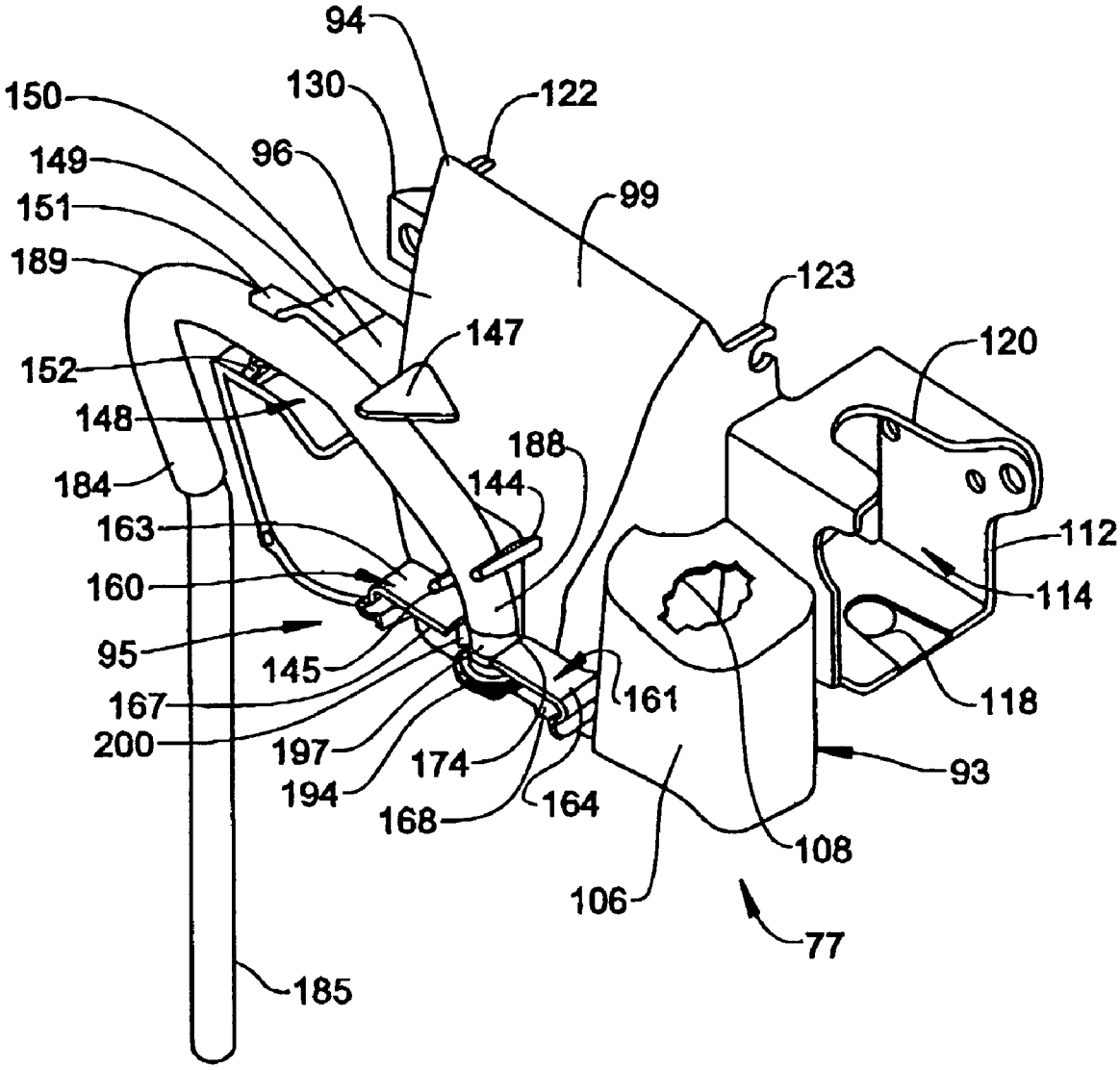
FIG. 3 is a detail view of the dispenser housing of FIG. 2 illustrating the liquid supply line passing through guide members and a clip to establish a curvilinear routing path.

As best shown in FIGS. 2 and 3, dispenser housing 77 includes an ice chute unit 93 designed to guides ice cubes from an icemaker (not shown) of refrigerator 2 into fill chamber 70. Towards that end, ice chute unit 93 is provided with an inlet portion 94, an outlet portion 95 and a main body portion 96 having a rear surface 99. Additionally, ice chute unit 93 includes a light housing 106 having an opening 108 for mounting a light bulb holder (not shown) that is selectively activated to illuminate fill chamber 70. Ice chute unit 93 is also preferably formed with a solenoid housing 112 for mounting a solenoid (not shown). Cavity 114 is shown to include a lower opening 118 and an upper opening 120 that establish a guide path for a solenoid plunger (not shown) that activates a flapper mechanism (also not shown) that is pivotally secured to a pair of mounting ears 122 and 123 provided at inlet portion 94. The flapper mechanism is typically maintained in a closed position to prevent ice cubes from inadvertently falling into fill chamber 70. However, upon placing a container within fill chamber 70 and activating release mechanism 83, the solenoid opens the flapper mechanism allowing ice cubes to pass through ice chute unit 93 into fill chamber 70 in a manner known in the art. Finally, ice chute unit 93 is shown to include a mounting lug 130 which, long with additional structure associated with solenoid housing 112, is employed to secure ice chute unit 93 to dispenser assembly 50 using mechanical fasteners (not shown).

In accordance with the invention, ice chute unit 93 is provided with structure which establishes and maintains a curvilinear routing path for liquid supply line 80. More specifically, a first pair of guide elements 144 and 145 extend from rear surface 99 of ice chute unit 93. Guide elements 144 and 145 are spaced from a second set of guide elements 147 and 148. Actually, guide element 148 includes an arcuate surface 149 that extends to a substantially horizontal surface 150 from which extends a clip 151. In a manner that will be discussed more fully below, clip 151 retains liquid supply line 80 against rear surface 99 of ice chute unit 93. In addition to guide elements 144, 145 and 147, 148, ice chute unit 93 includes first and second wall members 160 and 161 that are preferably arranged adjacent to outlet portion 95. As shown, first and second wall members 160 and 161 include respective upper surfaces 163 and 164, as well as corresponding lower surfaces 167 and 168. In the most preferred form of the invention, first and second wall members 160 and 162 are spaced from one another so as to define a slot 174 which, as will be detailed more fully below, positions liquid supply line 80 above fill chamber 70.

As set forth above, liquid supply line 80 is secured to rear surface 99 of main body portion 96. Towards that end, liquid supply line 80 includes a first end portion 184 that is connected to a liquid source through a tube 185, a second end portion 188 and an intermediate portion 189. As shown, second end portion 188 is positioned adjacent outlet portion 95 of ice chute unit 93, while being above fill chamber 70. More specifically, second end portion 188 is provided with a discharge nozzle 194 that is secured to second end portion 188 by a clamp 197. In the most preferred form of the invention, clamp 197 constitutes an ear-type clamp, formed from either metal or plastic, having a projecting ear or protrusion 200. Actually, clamp 197 could be a single ear-type clamp having a single protrusion 200 or, alternatively, a double ear-type clamp having multiple protrusions 200. In any case, protrusion 200 is adapted to abut lower surface(s) 167, 168 of first and/or second wall member(s) 160 and 161 to fixedly position second end portion 188 of liquid supply line 80 above fill chamber 70.

In order to properly position liquid supply line 80 on rear surface 99 of ice chute unit 93, second end 188 is placed within slot 174 with protrusion 200 arranged below either lower surface 167 or 168. Protrusion 200 is positioned so as to abut lower surface(s) 167 and/or 168 after which intermediate portion 189 is routed between guide members 144, 145 and 147, 148 along rear surface 99. Once in place on rear wall 99, nozzle 194 is locked in place by guide members 144, 145, 147, 148 and clip 152. In any event, intermediate portion 189 is finally snap-fit in place at clip 151 and retained by snap element 152 to ensure that liquid supply line 80 does not come loose while, at the same time, maintaining a smooth, curvilinear routing path.

With this overall arrangement, it should be understood that the present invention allows liquid supply line 80 to be easily mounted to rear surface 99 of dispenser housing 77. That is, the present invention enables manufacturing personnel to properly position and align a water supply line on a dispenser housing of a refrigerator without the need to employ mechanical fasteners. Likewise, positioning a clamp having a protrusion in a manner set forth in accordance with the present invention maintains the discharge portion of the water supply line in a proper orientation relative to the fill chamber.

Although described with reference to a preferred embodiment of the invention, it should be readily understood that various changes and/or modifications can be made to the invention without departing from the spirit thereof. For instance, the present invention is described in connection with a side-by-side refrigerator, it should be understood that a top mount or bottom mount refrigerator could benefit from the present invention. In general, the invention is only intended to be limited by the scope of the following claims.

I claim:

1. A refrigerator comprising:

a cabinet;

a liner arranged within the cabinet, said liner defining a fresh food compartment;

a door pivotally mounted relative to the cabinet;

an ice maker;

a dispenser for discharging a selected one of ice and water from the refrigerator, said dispenser having a fill chamber and a dispenser housing extending above the fill chamber;

a liquid supply line having a first end portion adapted to be attached to a water source and a second end portion;

a clamp fixedly securing the second end portion of the liquid supply line to the dispenser housing, said clamp including a protrusion that engages the dispenser housing to fixedly position the second end portion of the liquid supply line above the fill chamber; and a clip extending from the dispenser housing, said clip snap-fittingly engaging the liquid supply line in a predetermined orientation to maintain a curvilinear routing path for the liquid supply line along the dispenser housing.

2. A refrigerator comprising:

a cabinet;

a liner arranged within the cabinet, said liner defining a fresh food compartment;

a door pivotally mounted relative to the cabinet;

an ice maker;

a dispenser for discharging a selected one of ice and water from the refrigerator, said dispenser having a fill chamber and a dispenser housing extending above the fill chamber;

a liquid supply line having a first end portion adapted to be attached to a water source and a second end portion; and a clamp fixedly securing the second end portion of the liquid supply line to the dispenser housing, said clamp including a protrusion that engages the dispenser housing to fixedly position the second end portion of the liquid supply line above the fill chamber.

3. The refrigerator according to claim 2, wherein the dispenser housing includes an ice chute unit for guiding ice from the dispenser, said ice chute unit including an inlet portion, an outlet portion and a main body portion.

4. The refrigerator according to claim 3, further comprising: a plurality of guide members projecting outward from the main body portion of the ice chute unit, said liquid supply line passing between the plurality of guide members in establishing a curvilinear routing path.

5. The refrigerator according to claim 4, wherein the main body portion of the ice chute unit includes an arcuate support element, said liquid supply line passing over and be partially supported by the arcuate support element.

6. The refrigerator according to claim 2, further comprising: a discharge nozzle secured to the second end portion of the liquid supply line by the clamp.

7. The refrigerator according to claim 2, further comprising: first and second wall members projecting from the main body portion of the ice chute, each of said first and second wall members including an upper surface region and a lower surface region, said first and second wall members being spaced from one another so as to establish a slot, said liquid supply line passing through the slot with the clamp engaging a lower surface region of one of the first and second wall members.

8. The refrigerator according to claim 7, wherein the dispenser housing is injection molded from plastic.

9. The refrigerator according to claim 2, wherein the clamp is formed from metal.

10. The refrigerator according to claim 2, wherein the clamp is formed from plastic.

11. A refrigerator comprising:

a cabinet;

a liner arranged within the cabinet, said liner defining a fresh food compartment;

a door pivotally mounted relative to the cabinet;

an ice maker;

a dispenser for discharging a selected one of ice and water from the refrigerator, said dispenser having a fill chamber and a dispenser housing extending above the fill chamber;

a liquid supply line having a first end portion adapted to be attached to a water source and a second end portion; and a clip extending from the dispenser housing, said clip snap-fittingly engaging the liquid supply line in a predetermined orientation to maintain a curvilinear routing path for the liquid supply line along the dispenser housing.

12. The refrigerator according to claim 11, wherein the dispenser housing includes an ice chute unit for guiding ice from the dispenser, said ice chute unit including an inlet portion, an outlet portion and a main body portion.

13. The refrigerator according to claim 12, further comprising: a plurality of guide members projecting outward from the main body portion of the ice chute unit, said liquid supply line passing between the plurality of guide members in establishing the curvilinear routing path.

14. The refrigerator according to claim 13, wherein the main body portion of the ice chute unit includes an arcuate support element, said liquid supply line passing over and being partially supported by the arcuate support element.

15. A method of establishing and maintaining a desired routing path for a water line in a liquid dispensing assembly of a refrigerator comprising:

fixedly attaching a clamp to an end portion of the liquid supply line, said clamp establishing a protrusion;

engaging the protrusion with a dispenser housing extending above a fill chamber;

guiding the liquid supply line along an ice chute portion of the liquid dispenser housing; and clipping the liquid supply line to the dispenser housing.

16. The method of claim 15, wherein the liquid supply line is clipped to the ice chute portion of the dispenser housing.

17. The method of claim 15, further comprising: guiding the liquid supply line through a slot defined by first and second wall members of the dispenser housing, said protrusion formed on the clamp being placed in abutment with one of the first and second wall members.

18. The method of claim 15, further comprising:

attaching a discharge nozzle to the liquid supply line with the clamp; and mounting the discharge nozzle above the fill chamber of the liquid dispensing assembly.

19. The method of claim 15, wherein, in guiding the liquid supply line along the ice chute portion, the liquid supply line is routed in a curvilinear path.

* * * * *